United States Patent [19]

Beretta

[11] Patent Number: 4,811,511

[45] Date of Patent: Mar. 14, 1989

[54] DEVICE FOR RAPIDLY ENGAGING AND DISENGAGING THE TRIGGER MECHANISM IN THE BREECH OF A GUN

[75] Inventor: Pier G. Beretta, Gardone V.T., Italy

[73] Assignee: Fabbrica D'Armi P. Beretta S.p.A., Italy

[21] Appl. No.: 116,444

[22] Filed: Nov. 3, 1987

[30] Foreign Application Priority Data

Feb. 3, 1987 [IT] Italy ..... 5117 A/87

[51] Int. Cl.[4] ..... F41C 17/02

[52] U.S. Cl. ..... 42/70.06; 42/42.01

[58] Field of Search ..... 42/41, 69.01, 69.02, 42/69.03, 70.01, 70.06, 42.01

[56] References Cited

U.S. PATENT DOCUMENTS 4,646,457 3/1987 Verney-Carron ..... 42/41

4,662,098 5/1987 Timari ..... 42/69.01

*Primary Examiner*—Deborah L. Kyle

*Assistant Examiner*—Richard W. Wendtland

*Attorney, Agent, or Firm*—McGlew & Tuttle

[57] ABSTRACT

Disclosed is a device for the rapid engagement and disengagement of the monotrigger mechanism in the breech of a double-barrelled gun. A hook is integrally provided in the underguard that carries the monotrigger mechanism. An oscillating lever, pivoting in the breech has a tooth that interacts with the said hook, so as to block and unblock the monotrigger mechanism. The lever is kept in operative position by a spring and is moved into an inoperative position by the disengagement of the monotrigger mechanism from the safety sled.

6 Claims, 3 Drawing Sheets

DEVICE FOR RAPIDLY ENGAGING AND DISENGAGING THE TRIGGER MECHANISM IN THE BREECH OF A GUN

FIELD OF THE INVENTION

The invention relates to shotguns with two barrels and a single trigger and, particularly, to a device for rapidly engaging and disengaging the trigger mechanism in the breech of these guns.

Attention is directed to applicant's copending application, Ser. No. 116654, the disclosure of which is incorporated herein by reference.

BACKGROUND OF THE INVENTION

In the field of double-barrelled shotguns, the barrels being positioned either side by side or one over the other, there are already known several trigger mechanisms, hereinafter referred to as monotrigger mechanisms, with two hammers, corresponding to the two barrels of the gun, and with a single trigger, for controlling, through levers and preloaded springs, the disengagement of the cocked hammers.

In the conventional arrangements, the elements of a monotrigger mechanism are premounted on a support, hereinafter referred to as the underguard, which is applicable to the lower portion of the breech of a gun, in correspondence with a suitable opening or slit. The position mounting of the underguard and, consequently, of the monotrigger mechanism is normally achieved, on one hand, by engaging the front end of the underguard in a complementary seat provided in the breech and, on the other hand, by attaching the tail end of the underguard to the breech by means of a spine, a screw or other similar fastener, more or less complex.

The above allows the assembling and disassembling, as a unit, of the monotrigger mechanism on a gun. However, the present systems of positioning of the monotrigger mechanisms are neither simple, nor user friendly, as it would also be desirable in order to eliminate the need of having to employ tools in the process.

To the monotrigger mechanism is, usually also associated a safety sled which is mounted and is slidable on the upper portion of the breech of the gun and has a portion thereof that is intended to interfere with a member of the monotrigger mechanism, so as to prevent the use of the latter when the gun is in position of safety.

BRIEF DESCRIPTION OF THE INVENTION

The present invention is instead directed to a device for the rapid engagement and disengagement of the monotrigger mechanism in the breech of a gun, according to claim 1.

It is, therefore, an object of the present invention to provide a device that employs real means for attaching the underguard to the breech; means that are actuated both easily and comfortably through the safety sled of the gun, so as to allow also the rapid assembly and disassembly of the monotrigger mechanism without recurring to extraneous tools.

THE DRAWINGS

Greater details of the invention will become apparent from the following description of the embodiments thereof, with reference to the accompanying drawings, in which.

Figure 1:
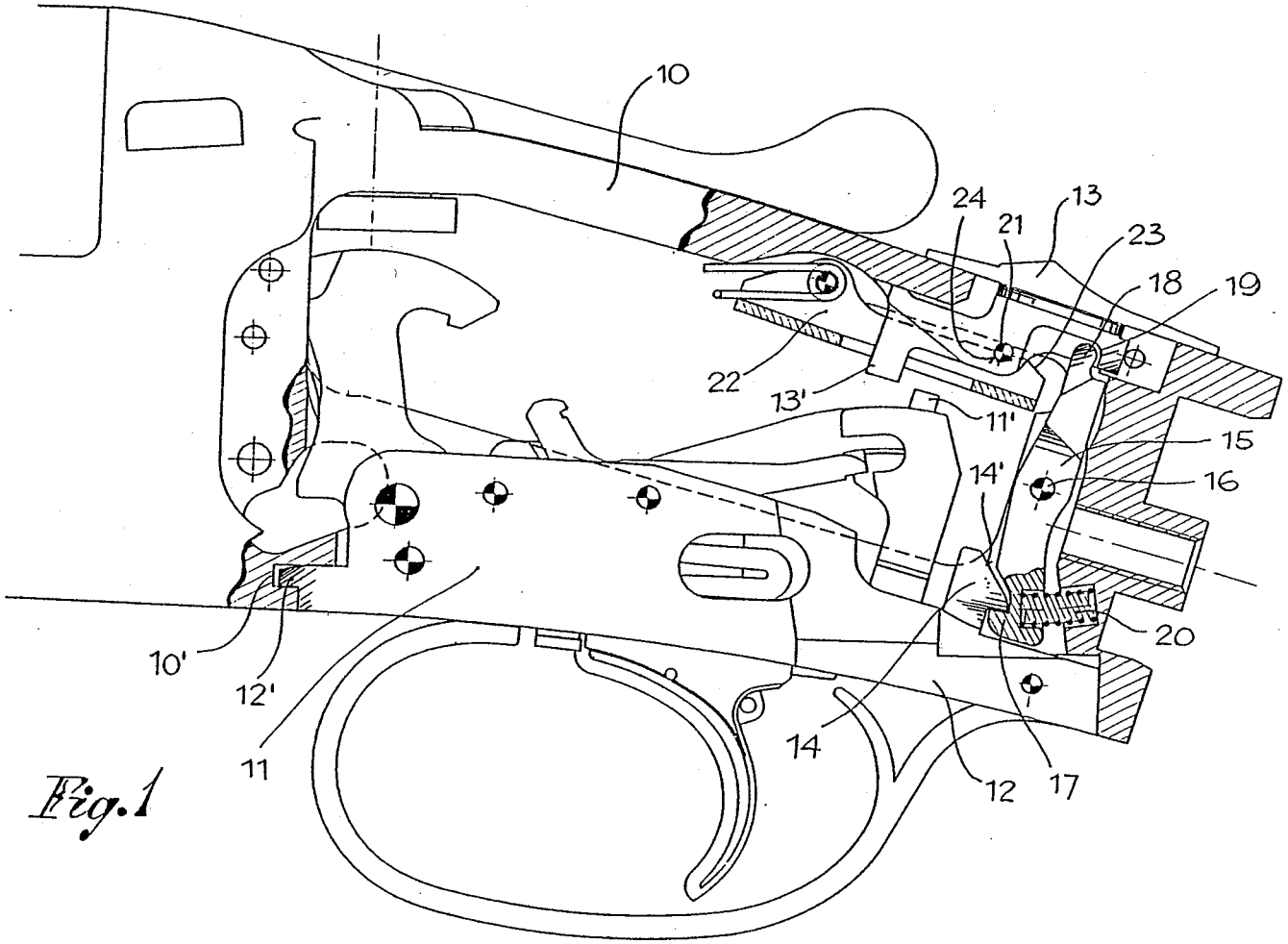
FIG. 1 is a schematic view of the monotrigger mechanism in the position of engagement in the breech of the gun.

DETAILED DESCRIPTION OF THE INVENTION:

Referring now to the drawings, numeral 10 represents generally the breech of a gun, in which is to be mounted a monotrigger mechanism 11. The members of the monotrigger mechanism 11 are premounted, in a manner known per se, on an underguard 12 which is applicable to the lower portion of the breech 10. In the upper portion of the breech 10 instead, there is mounted a slidable safety sled 13, which has an arresting portion 13' facing the monotrigger mechanism 11 and intended to interfere with element 11' of the latter to effect the safety positioning of the gun (see FIG. 3).

In order to apply the underguard 12 to the breech 10, the former has a front tongue 12' which is intended to be inserted in a complementary seat 10' provided in the breech itself. In its rear part, the underguard 12 is integrally formed with a hook 14 which faces toward the interior of the breech 10, behind the monotrigger mechanism 11, and has a bevelled head 14'.

In the breech 10, between the hook 14 and the safety sled 13, there is a latching lever 15 pivotally mounted on an intermediate transverse pin 16. Lever 15 has, on one side, a or catch tooth 17 for engagement with the hook 14, integral with the underguard 12, and on the other side, a terminal 18 for interacting with a shoulder 19 provided at the base of the safety sled 13. Lever 15 is, furthermore, actuated by a preloaded spring 20 which keeps the tooth 17 of the lever normally engaged with the hook 14 and the terminal 18 displaced toward the shoulder 19 of the safety sled 13.

In practice, the underguard 12, complete with monotrigger mechanism 11, is mounted on and attached to the breech 10 by, firstly, engaging the front tongue 12' in its complementary seat 10' and, subsequently, by pushing the monotrigger mechanism 11 in the breech 10 until the hook 14 and the tooth 17 of the lever 15 are reciprocally engaged. The coupling is facilitated by the bevelled heat 14' of the hook 14 and by the action of the spring 20 on the lever 15, without need of actuating any other member of the gun.

The safety sled 13 is provided with a peg 21 that interacts with a spring-loaded pusher 22. Pusher 22 has a ramp 23 which defines, together with the peg 21, the position of safety, and an intermediate cavity 24 which defines, again together with the peg 21, the position of firing, that is to say, of operation of the gun.

Figure 3:
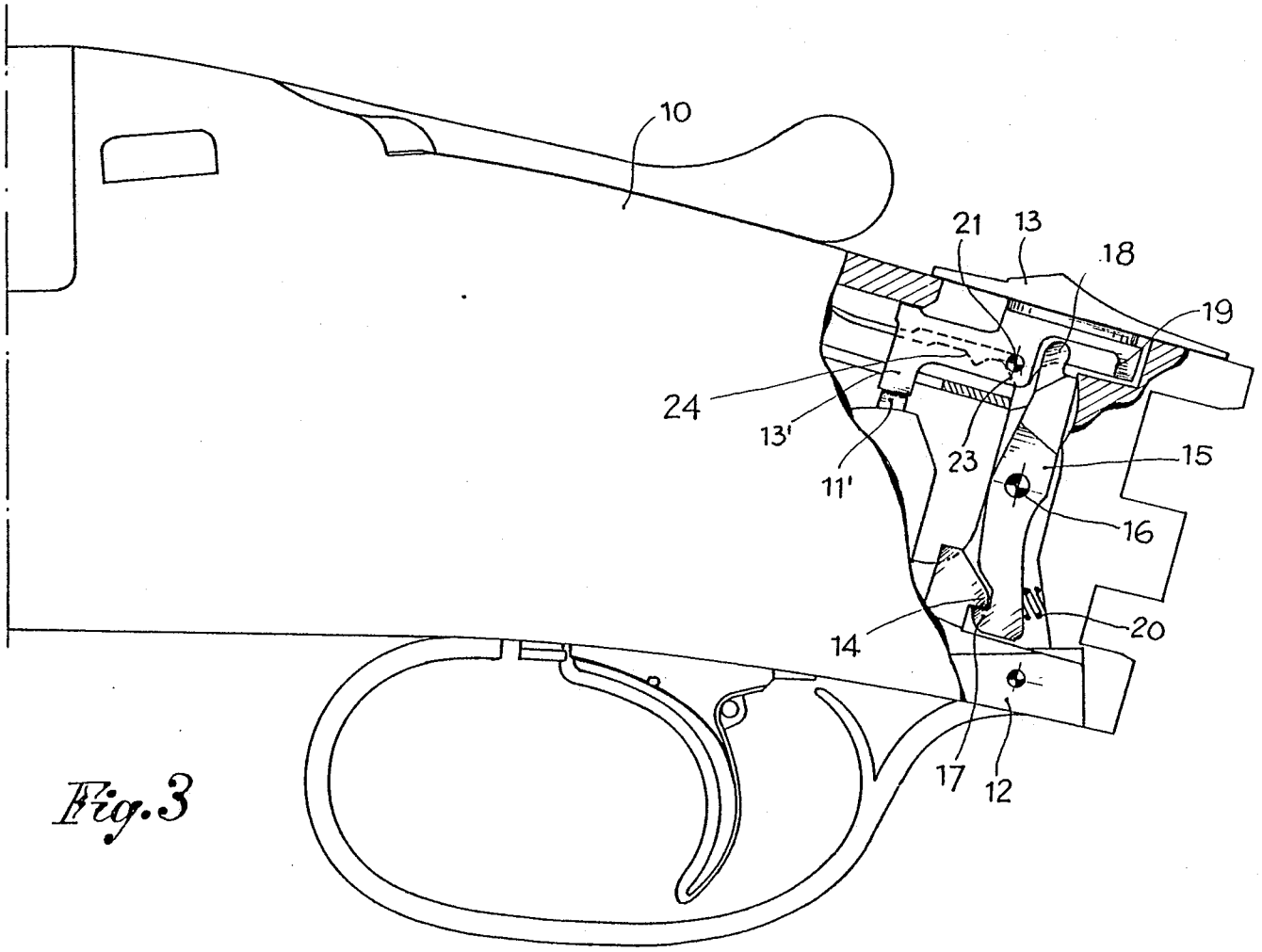
FIG. 3 represents the condition of safety of the monotrigger mechanism.

In the position of safety, the sled 13 is displaced fully to the rear, so that its arresting portion 13' interferes with the member 11' of the monotrigger mechanism, thus preventing the latter from operating. At the same time, the shoulder 19 is moved away from the terminal 18 of the lever 15, as it is shown in FIG. 3 of the drawings. In the position of firing, the safety sled 13 is halted in an intermediate position, due to the positioning of its peg 21 in the cavity 24 of the pusher 22. The shoulder 19 is adjacent to the terminal 18 of the lever 15, without, however, altering the position of the latter (see FIG. 1).

In either position, of safety and of firing, the safety sled has no influence whatever upon the lever 15, so that the condition of engagement and of attachment of the monotrigger mechanism in the breech of the gun is not altered, when one passes from one position to the other.

Figure 2:
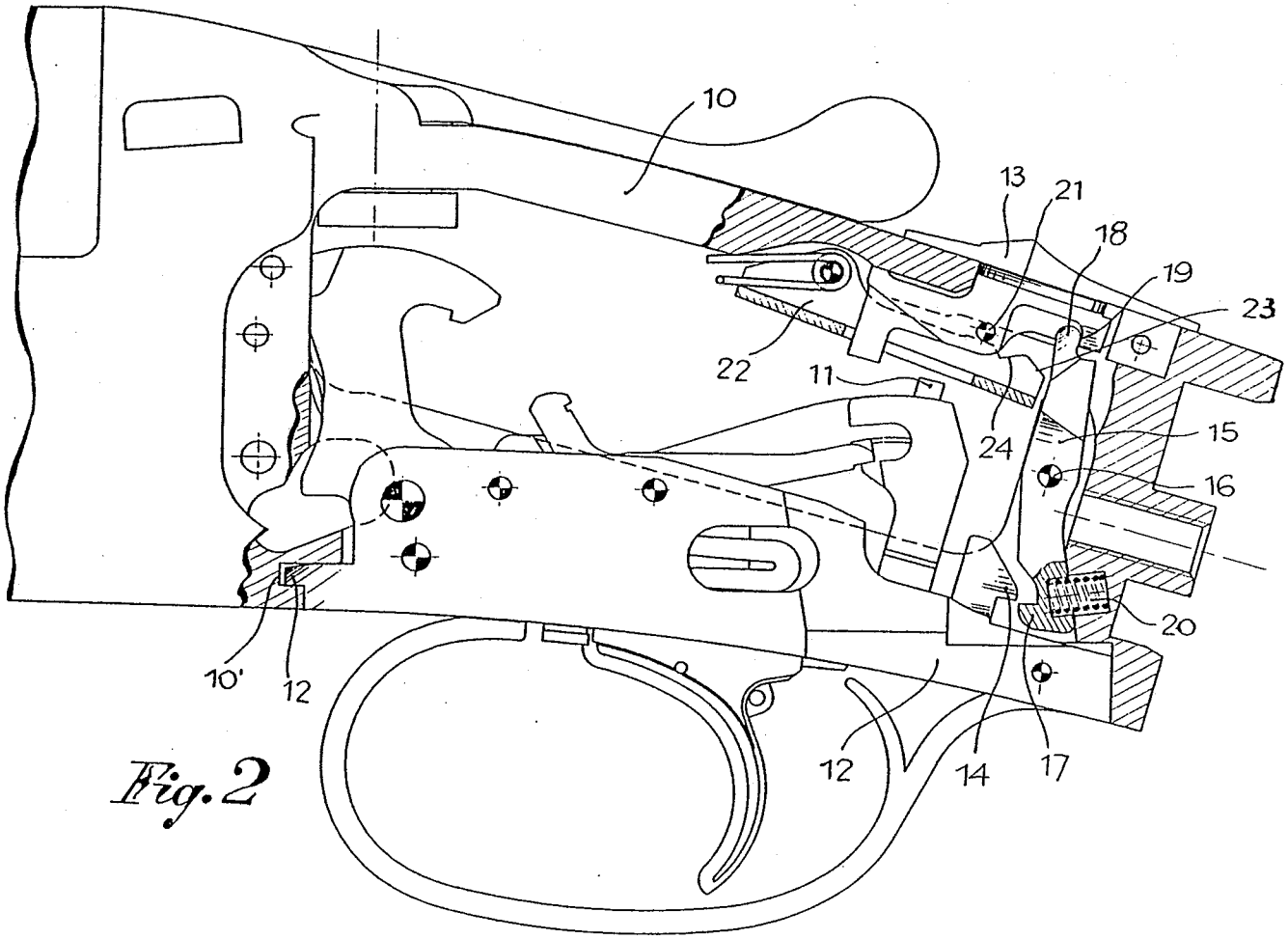
FIG. 2 is a similar view, analogous to FIG. 1, showing the monotrigger mechanism in disengaged condition.

The safety sled 13 is, nevertheless, displaceable manually toward the front and beyond the position of firing. This permits the disengagement of the monotrigger mechanism 11, when it is necessary to remove it from the breech 10. As a result of such a displacement of the safety sled 13, the shoulder 19 acts against the terminal 18 of the lever 15, displacing the latter in opposition to the spring 20. Tooth 17 of the lever 15 is, meanwhile moved away and disengaged from the hook 14 of the underguard 12, as it is shown in FIG. 2 of the drawings.

The monotrigger mechanism 11, now free, can be removed from the breech 10. When the manual action on the safety sled has ended, the spring 20 returns the lever 15 and, through the contact of its terminal 18 with the shoulder 19, the safety sled 13 to the position of firing, or to the position in which the described device is preplaced for engaging the holding the monotrigger mechanism, when the latter is remounted in the breech.

What is claimed is:

1. In a device for the rapid engagement and disengagement of a trigger mechanism in a breech of a gun, the trigger mechanism having member elements premounted on an underguard having a front portion and a rear portion, the breech having a lower portion with the underguard applied thereto and an upper portion with a safety sled slidably mounted thereon, the improvement which comprises: a tongue provided in the front portion of said underguard; a complementary seat provided in said breech for receiving said tongue; a hook provided in the rear portion of said underguard, said hook facing toward the interior of said breech; a pivotal lever in said breech, having a tooth and a terminal spaced apart thereon; the lever being pivotally mounted in the breech for pivotal movement between positions in which said tooth engages with and disengages from said hook respectively for blocking and unblocking said trigger mechanism in the breech; said terminal being arranged to interact with said safety sled for controlling manually the disengagement of said monotrigger mechanism; and a spring acting on said pivotal lever biassing the tooth into engagement with the hook insuring the engagement of said trigger mechanism.

2. A device according to claim 1, wherein said hook is integral with said underguard and has a bevelled head interacting with said pivotal lever, when said trigger mechanism is inserted in said breech; and wherein said safety sled is mounted for manual sliding displacement between a safety position, a firing position and a further position, the safety sled having a shoulder which engages said terminal thereby to disengage said tooth from said hook when said sled is manually displaced into the said other position.

3. A device according to claim 1 wherein the member elements of the trigger mechanism premounted on the underguard include at least one hammer, a spring biassing the hammer in the firing direction and an operating lever mechanism releasably linking the hammer with the trigger.

4. A gun comprising a breech having an upper portion and a lower portion providing a cavity with front and rear ends;

an underguard having front and rear portions provided respectively with tongue and hook means;

a trigger mechanism carried by the underguard between the front and rear portions;

the breech having a complementary seat for the tongue means located at the front end of the underguard receiving cavity;

a safety sled;

means mounting the safety sled on the upper portion of the breech for manually operated, linear sliding movement from a rear, safety position, through an intermediate, firing position, to a front position;

an abutment carried by the safety sled;

releasable underguard latching means comprising a lever having opposite ends formed as a terminal and a catch respectively, means pivotally mounting the lever at the rear end of the breech cavity with the terminal adjacent and operatively aligned in front of the safety sled abutment, for pivotal movement of the catch between hook engaging and disengaging positions;

spring means mounted in the cavity operatively engaging the lever to bias the catch into the hook engaging position;

whereby the underguard carrying the trigger mechanism can be releasably mounted in the breech cavity by engagement of the tongue means with the complementary seat and engagement of the lever catch with the underguard hook with a snap action and forward manual linear movement of the safety sled to the front position causes the rear abutment to engage the terminal to pivot the lever against the spring bias to disengage the catch from the hook thereby to unlatch the underguard, permitting withdrawal thereof with the trigger mechanism from the breech.

5. A gun according to claim 3 wherein the safety sled carries a second abutment spaced forwardly of the first abutment such that the abutments defined between them a terminal receiving space, the terminal being located in the terminal receiving space, whereby when the safety sled is in the rear, safety position, pivotal movement of the lever to release the underguard latching means is prevented by engagement of the terminal with the second abutment.

6. A gun according to claim 4 wherein the trigger mechanism carried by the underguard includes at least one hammer, a spring biassing the hammer in the firing condition, and an operating lever mechanism releasably linking the hammer with the trigger.

* * * * *